US007404618B2

(12) United States Patent
Lim et al.

(10) Patent No.: US 7,404,618 B2
(45) Date of Patent: Jul. 29, 2008

(54) INKJET PRINTER

(75) Inventors: Gui-taek Lim, Suwon-si (KR); Tae-kyun Kim, Yongin-si (KR); Kyung-chool Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 280 days.

(21) Appl. No.: 10/975,089

(22) Filed: Oct. 28, 2004

(65) Prior Publication Data

US 2005/0122374 A1 Jun. 9, 2005

(30) Foreign Application Priority Data

Dec. 4, 2003 (KR) ..... 10-2003-0087477

(51) Int. Cl.
*B41J 2/165* (2006.01)

(52) U.S. Cl. ..... 347/33; 347/29

(58) Field of Classification Search ..... 347/29, 347/30, 104, 33, 28, 32
See application file for complete search history.

(56) References Cited

U.S. PATENT DOCUMENTS

| | | | | |
|---|---|---|---|---|
| 6,592,200 | B2 | 7/2003 | Wotton et al. | |
| 6,672,705 | B2 * | 1/2004 | Kitahara et al. | 347/42 |

FOREIGN PATENT DOCUMENTS

| | | |
|---|---|---|
| JP | 07-276620 | 10/1995 |
| JP | 07-276657 | 10/1995 |
| JP | 2001-001510 | 1/2001 |
| KR | 1999-0063801 | 7/1998 |

* cited by examiner

*Primary Examiner*—Manish S Shah
(74) *Attorney, Agent, or Firm*—Stanzione & Kim, LLP

(57) ABSTRACT

An inkjet printer includes an ink cartridge including an ink container storing ink and fixed to a body of a printer, a printhead assembly including a plurality of nozzle plates, each including a plurality of nozzles ejecting ink supplied from the ink container, disposed on the bottom of the ink cartridge, and extending in a direction perpendicular to a paper moving direction, a platen disposed a predetermined distance below the printhead assembly, the platen supporting a sheet of paper moving in the paper moving direction, and having a plurality of slits extending in a direction perpendicular to the paper moving direction such that they correspond to the nozzle plates, and a wiping apparatus within the platen, the wiping apparatus protruding through the slits, moving in the direction perpendicular to the paper moving direction, and wiping the nozzle plates.

31 Claims, 3 Drawing Sheets

INKJET PRINTER

CROSS-REFERENCE TO RELATED APPLICATIONS

This application claims the priority of Korean Patent Application No. 2003-87477, filed on Dec. 4, 2003, in the Korean Intellectual Property Office, the disclosure of which is incorporated herein in its entirety by reference.

BACKGROUND OF THE INVENTION

1. Field of the Invention

The present general inventive concept relates to a wiping apparatus cleaning nozzles of a printhead assembly that covers the width of a sheet of paper.

2. Description of the Related Art

Ink cartridges for inkjet printers store ink and print predetermined images by ejecting droplets of the ink at desired positions on a recording sheet through a printhead. Ink containers of the ink cartridges must be kept at a lower pressure than their atmosphere to prevent leakage of an excessive amount of ink through the printheads or a wetting phenomenon at the printheads.

When nozzles of the printheads are clogged with dust, the ink cartridges are moved to a service station, and the printheads are wiped by wiping blades. Conventional printheads having one nozzle plate are commonly used in inkjet printers. The printhead is located on the bottom of the ink cartridge, which is mounted on the carriage moving in a main scanning direction perpendicular to a paper feeding direction. A plurality of nozzles formed at the printhead eject droplets of ink on a printing medium when the printhead is moving in the main scanning direction.

Inkjet printers having large-sized printheads including a plurality of nozzle plates have recently been developed. Japanese Patent Application No. 2001-1510 discloses a large-sized printhead having a plurality of nozzle plates arranged parallel to the paper feeding direction, and thus, a plurality of lines can be printed in one swath.

On the other hand, U.S. Pat. No. 6,592,200 discloses a printhead assembly including a plurality of nozzle plates arranged in the main scanning direction. When this printhead assembly is used, printing can be performed by moving only a sheet of paper while the printhead assembly remains stationary.

U.S. Pat. No. 6,592,200 discloses wipers corresponding to printheads. There are as many of the wipers as nozzle plates of the printhead assembly.

SUMMARY OF THE INVENTION

The present general inventive concept provides a wiping apparatus of a printhead assembly wiping nozzle plates of the stationery printhead assembly by moving wiper blades linearly.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing an inkjet printer including an ink cartridge including an ink container storing ink and fixed to a main body of a printer, a printhead assembly including a plurality of nozzle plates, each including a plurality of nozzles ejecting ink supplied from the ink container, disposed on the bottom of the ink cartridge, and arranged in a main scanning direction perpendicular to a paper feeding direction, a platen disposed a predetermined distance below the printhead assembly, the platen supporting a sheet of paper fed in the paper feeding direction, and having a slit formed in the main scanning direction to correspond to the nozzle plates, and a wiping apparatus protruding through the slit, moving in the main scanning direction, and wiping the nozzle plates.

The wiping apparatus may include a wiper blade wiping the nozzle plate and a unit providing horizontal movement moving the wiper blade in the main scanning direction. The unit providing horizontal movement may include a wiper carriage to which the wiper blades are attached, a traveling belt connected to one end of the wiper carriage and moving the wiper carriage in the main scanning direction by a carriage motor, and a guide rail supporting the wiper carriage and guiding a path of the wiper carriage.

The guide rail may be straight in a region corresponding to the slit and lowered in a region where the slit is not formed such that the unit providing vertical movement adjusts the position of the wiper blade to be placed lower than a surface of the platen during printing.

The foregoing and/or other aspects and advantages of the present general inventive concept are achieved by providing an inkjet printer including an ink cartridge including a plurality of ink containers storing a plurality of colors of ink and fixed to a main body of a printer, a printhead assembly including a plurality of nozzle plates, each including a plurality of nozzles ejecting ink supplied from one of the ink containers, disposed on the bottom of the ink cartridge, and arranged in a main scanning direction perpendicular to a paper feeding direction, a platen disposed a predetermined distance below the printhead assembly, the platen supporting a sheet of paper fed in the paper feeding direction, and having a plurality of slits formed in the main scanning direction to correspond to the nozzle plates for each color ink, and a wiping apparatus protruding through the slits, moving in the main scanning direction, and wiping the nozzle plates.

The wiping apparatus may include wiper blades wiping the nozzle plate and a unit providing horizontal movement moving the wiper blades in the main scanning direction. The wiper blades comprise separated ends to contact corresponding nozzle plates for each color.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
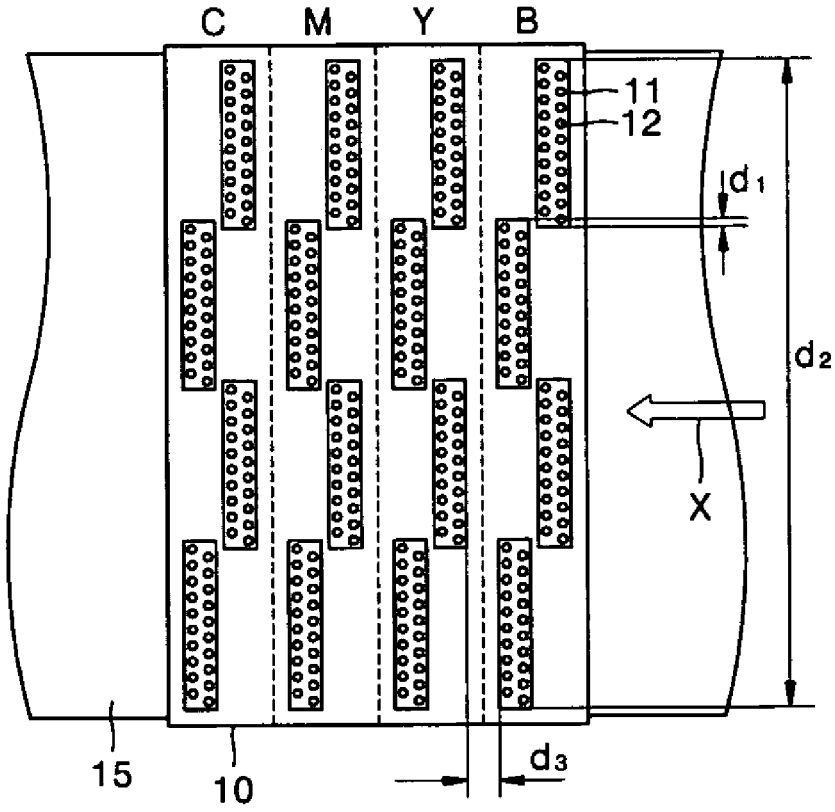
FIG. 1 is a schematic view illustrating an arrangement of nozzle plates of a printhead assembly applied to an inkjet printer, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic view illustrating an arrangement of nozzle plates of a printhead assembly applied to an inkjet printer according to an embodiment of the present general inventive concept.

Referring to FIG. 1, a printhead assembly 10 of a color inkjet printer includes a plurality of nozzle plates 11 ejecting black, yellow, magenta, and cyan ink, respectively. In other words, four nozzle plates 11 for each color are disposed in a main scanning direction perpendicular to a paper feeding direction, indicated by an arrow X, and overlap one another. An effective length of each nozzle plate is 2.1 inches. When an overlapping length $d_1$ is 0.1 inch, an effective length $d_2$ of the printhead assembly 10 in the main scanning direction is 8.1 inches. Therefore, a sheet of paper 15 having an effective width less than 8.1 inches, for example, A4 paper, can be printed on.

Each of the nozzle plates 11 includes a plurality of nozzles 12 ejecting ink and arranged in two rows in an alternating fashion. The nozzles can be arranged in three or more rows. There is a predetermined distance $d_3$ between nozzle plates 11 ejecting different color ink. Wires applying signals to each nozzle are disposed between the distance $d_3$.

Figure 2:
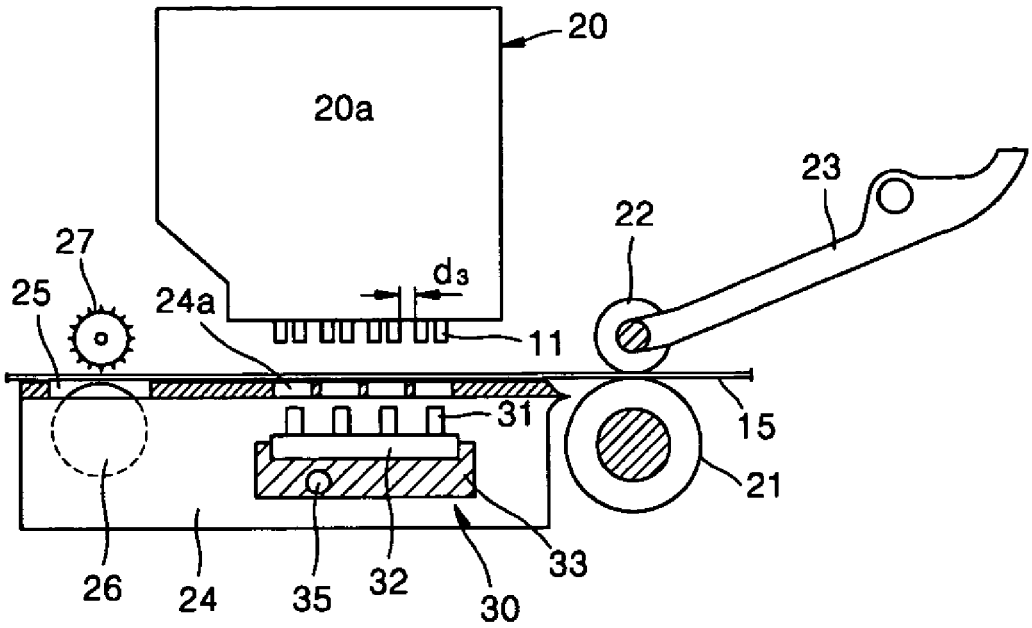
FIG. 2 is a side view of a printhead wiping apparatus, according to an embodiment of the present general inventive concept.
Figure 3:
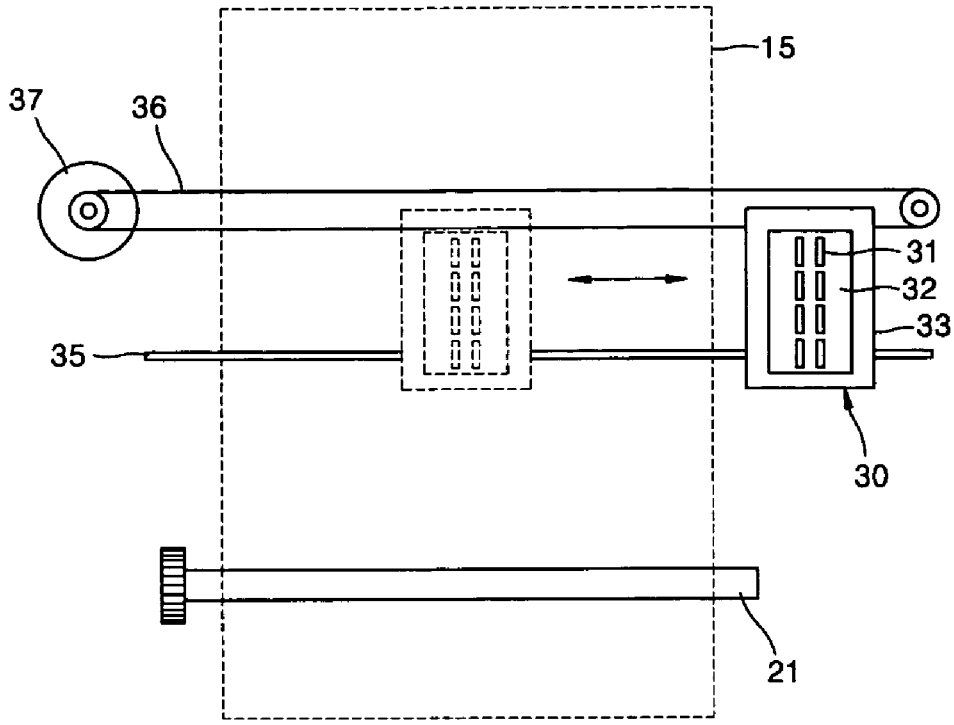
FIG. 3 is a plan view of the printhead wiping apparatus illustrated in FIG. 2.

FIG. 2 is a side view of a printhead wiping apparatus according to an embodiment of the present general inventive concept. FIG. 3 is a plan view of the printhead wiping apparatus illustrated in FIG. 2.

Referring to FIGS. 2 and 3, a friction roller 22 is disposed above a feeding roller 21 and contacts the feeding roller 21 supplying a sheet of paper 15 fed from a pick-up roller (not shown) to a printing region. The friction roller 22 is rotatably connected to one end of a friction roller holder 23. Another end of the friction roller holder 23 is connected to the body of the printer.

An ink cartridge 20 and a platen 24 are disposed downstream from the feeding roller 21 along a paper path. The platen 24 supports the sheet of paper 15. The ink cartridge 20 is fixed to the body of the printer. The printhead assembly 10 ejecting color ink is disposed on the bottom of the ink cartridge 20. The printhead assembly 10 includes a plurality of nozzle plates 11 for each color ink arranged in two rows in an alternating fashion. A plurality of grooves 25 are formed at the rear part of the platen 24. An ejecting roller 26 is disposed in the grooves 25, and a star wheel is disposed on the ejecting roller 26.

A plurality of slits 24*a* corresponding to the nozzle plates 11 for each color of ink are formed at a top of the platen 24 in the main scanning direction. A wiping apparatus wiping the nozzle plates 11 is formed under the surface of the platen 24. The wiping apparatus includes wiper blades 31 facing the slits 24*a*, a wiper 32 to which the wiper blades 31 are attached, and a wiper carriage 33 on which the wiper 32 is mounted. The wiping apparatus further includes a traveling belt 36 connected to one side of the wiper carriage 33 and moving the wiper carriage 33 in the main scanning direction and a guide rail 35 perforating another side of the wiper carriage 33 and guiding a moving path of the wiper carriage 33.

On the other hand, the wiping apparatus may be moved vertically by a unit providing vertical movement. In a region where the slits 24*a* are formed, the unit providing vertical movement allows the wiper blades 31 to protrude through the slits 24*a* and contact the nozzle plates 11 of the printhead assembly 10. Where the slits 24*a* are not formed, the unit providing vertical movement adjusts the position of the wiper blades 31 below the surface of the platen 24.

Figure 4:
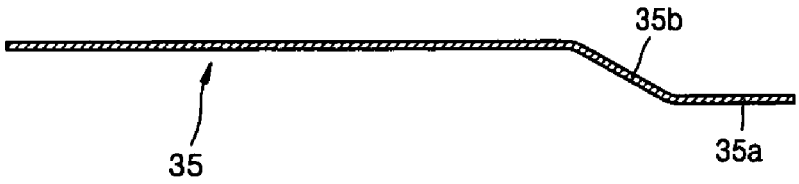
FIG. 4 is a view of a guide rail of FIG. 3.

Referring to FIG. 4, the guide rail 35 may be straight in the region where the slits 24*a* are formed and may be lowered where the slits 24*a* are not formed. In the case of a mono color printer, a single black ink container is installed. In the case of a color inkjet printer, a plurality of ink containers, one for each color, are installed.

Hereinafter, the operation of the wiping apparatus of the printhead assembly of the inkjet printer will be described with reference to the attached drawings. First, the sheet of paper 15 fed from the pick-up roller (not shown) is passed between the rotating friction roller 22 and the feeding roller 21. The sheet of paper 15 is forced into the paper path by friction between the feeding roller 21 and the sheet of paper 15.

The nozzles 12 of the printhead assembly 10 for each color of ink sequentially ejects ink onto the sheet of paper 15 disposed on the platen 24. In other words, after black ink is ejected, the sheet of paper 15 is moved a predetermined distance in the X direction by the feeding roller 21. Then, yellow ink, the magenta ink, and the cyan ink are ejected sequentially, thereby forming an image on the sheet of paper 15. The sheet of paper 15 is then pushed out of the printer by the ejecting roller 26. While printing is underway, the wiping apparatus is disposed in a position marked by solid lines in FIG. 3.

Meanwhile, when ink is not ejected from the ink cartridge 20 because the nozzles 12 are clogged, the wiper carriage 33 is moved to the printing region by driving a carriage motor 37. When the wiper carriage 33 passes from a lower portion 35*a* to a slanted portion 35*b* of the guide rail 35, the wiper carriage 33 is elevated to a predetermined height. Here, the wiper blades 31 perforate the slits 24*a* and protrude from the surface of the platen 24. As the wiper carriage 33 continues to move (see the wiping apparatus marked by dotted lines in FIG. 3), the wiper blades 31 wipe the nozzle plates 11 of the printhead assembly 10. Since each of the wiper blades 31 corresponding to each color ink wipes only the nozzle plates 11 for the corresponding color ink, the wiper blades 31 do not mix colors on the surface of the nozzle plates 11. In addition, the wiper blades 31 may be formed in pairs for the nozzle plates 11 for one color of ink, as illustrated in FIG. 4.

In the present embodiment, the wiper 32 is disposed under the platen 24 during printing. However, if the guide rail 35 is straight, and the slits 24*a* formed at the platen 24 extend to where the wiper 32 is positioned during printing, the unit providing vertical movement is not needed.

As described above, a printhead assembly wiping apparatus according to an embodiment of the present general inventive concept uses exclusive wipers for nozzle plates for each color. Therefore, the wiper does not mix colors of the printhead assembly.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printer comprising:

an ink cartridge comprising an ink container storing ink and fixed to a main body of the printer;

a printhead assembly comprising a plurality of nozzle plates, each nozzle plate comprising a plurality of nozzles ejecting ink supplied from the ink container, disposed on the bottom of the ink cartridge, and arranged in a main scanning direction perpendicular to a paper feeding direction;

a platen disposed a predetermined distance below the printhead assembly, the platen supporting a sheet of paper fed in the paper feeding direction and having a slit formed in the main scanning direction to correspond to the nozzle plates; and a wiping apparatus protruding through the slit, moving in the main scanning direction, and wiping the nozzle plates.

2. The inkjet printer of claim 1, wherein the wiping apparatus comprises a wiper blade wiping the nozzle plate and a unit providing horizontal movement moving the wiper blade in the main scanning direction.

3. The inkjet printer of claim 2, wherein the unit providing horizontal movement comprises:

a wiper carriage to which the wiper blades are attached;

a traveling belt connected to one end of the wiper carriage and moving the wiper carriage in the main scanning direction by a carriage motor; and a guide rail supporting the wiper carriage and guiding a path of the wiper carriage.

4. The inkjet printer of claim 3, wherein the wiping apparatus further comprises a unit providing vertical movement selectively moving the wiper blade in the vertical direction.

5. The inkjet printer of claim 3, wherein the guide rail is straight in a region corresponding to the slit and lowered in a region where the slit is not formed such that the unit providing vertical movement adjusts the position of the wiper blade to be placed lower than a surface of the platen during printing.

6. An inkjet printer comprising:

an ink cartridge comprising a plurality of ink containers storing a plurality of colors of ink and fixed to a main body of the printer;

a printhead assembly comprising a plurality of nozzle plates, each nozzle plate comprising a plurality of nozzles ejecting ink supplied from one of the ink containers, disposed on the bottom of the ink cartridge, and arranged in a main scanning direction perpendicular to a paper feeding direction;

a platen disposed a predetermined distance below the printhead assembly, the platen supporting a sheet of paper fed in the paper feeding direction, and having a plurality of slits formed in the main scanning direction to correspond to the nozzle plates for each color ink; and a wiping apparatus protruding through the slits, moving in the main scanning direction, and wiping the nozzle plates.

7. The inkjet printer of claim 6, wherein the wiping apparatus comprises wiper blades wiping the nozzle plate and a unit providing horizontal movement moving the wiper blades in the main scanning direction.

8. The inkjet printer of claim 7, wherein the wiper blades comprise separated ends to contact corresponding nozzle plates for each color.

9. The inkjet printer of claim 7, wherein the unit providing horizontal movement comprises:

a wiper carriage to which the wiper blades are attached;

a traveling belt connected to one end of the wiper carriage and moving the wiper carriage in the main scanning direction by a carriage motor; and a guide rail supporting the wiper carriage and guiding a path of the wiper carriage.

10. The inkjet printer of claim 7, wherein the wiping apparatus further comprises a unit providing vertical movement selectively moving the wiper blades in the vertical direction.

11. The inkjet printer of claim 10, wherein the guide rail is straight in a region corresponding to the slits and lowered in a region where the slits are not formed such that the unit providing vertical movement adjusts the position of the wiper blade to be placed lower than a surface of the platen during printing.

12. An inkjet printer comprising:

an ink storage unit storing a plurality of colors of ink and fixed to a main body of the printer;

a printhead assembly disposed at a bottom portion of the ink storage unit and comprising a plurality of nozzle plates, each nozzle plate comprising a plurality of nozzles ejecting ink, disposed on the bottom of the ink cartridge, and arranged in a main scanning direction perpendicular to a paper feeding direction;

a platen disposed a predetermined distance below the printhead assembly, the platen supporting a sheet of paper fed in the paper feeding direction and having a plurality of slits formed in the main scanning direction to correspond to the nozzle plates for each color ink; and a wiping apparatus to protrude through the slits and to move in the main scanning direction, to wipe the nozzle plates when the nozzles are clogged.

13. The inkjet printer of claim 12, wherein the wiper apparatus comprises:

plural wiper blades each corresponding to a respective color ink and facing the slit;

a wiper to which the wiper blades are attached;

a wiper carriage on which the wiper is mounted;

a guide rail on which the wiper carriage is moved along to perform wiping of the nozzle plates; and a carriage motor to drive the wiper carriage along the guide rail when the nozzle plates are clogged.

14. The inkjet printer of claim 13, wherein the guide rail is shaped such that the wiper carriage is positioned below the platen when not vertically aligned with the slits, and is positioned above the platen and contacting the nozzle plates when vertically aligned with the slits.

15. The inkjet printer of claim 13, wherein the guide rail is straight and the slits formed at the platen extend to where the wiper is positioned during printing.

16. The inkjet printer of claim 13, wherein the guide rail is straight in a region where the slits are formed and is lowered where the slits are not formed.

17. The inkjet printer of claim 13, wherein the carriage motor comprises a traveling belt to pull the wiper carriage along the guide rail.

18. The inkjet printer of claim 13, wherein the wiper blades are formed in pairs for the nozzle plates for one color of ink.

19. The inkjet printer of claim 12, wherein the wiper apparatus comprises:

plural wiper blades each corresponding to a respective color ink and facing the slit;

a wiper to which the wiper blades are attached;

a wiper carriage on which the wiper is mounted;

a guide rail on which the wiper carriage is moved along to perform wiping of the nozzle plates; and a carriage motor to drive the wiper carriage along the guide rail when the nozzle plates are not ejecting ink.

20. The inkjet printer of claim 13, wherein the nozzle plates are provided in three or more rows, each row ejecting a predetermined color of ink.

21. An inkjet printer comprising:

an ink cartridge comprising an ink container to store ink and fixed to a main body of the printer;

a printhead assembly comprising a plurality of nozzle plates, each nozzle plate comprising a plurality of nozzles to eject ink supplied from the ink container, disposed on the bottom of the ink cartridge, and arranged in a main scanning direction perpendicular to a paper feeding direction;

a supporting member disposed a predetermined distance below the printhead assembly, the supporting member to support a sheet of paper fed in the paper feeding direction and having a slit formed in the main scanning direction to correspond to the nozzle plates; and a wiping apparatus that protrudes through the slit, to move in the main scanning direction, and to wipe the nozzle plates.

22. An inkjet printer comprising:

an ink storage unit to store ink and fixed to a main body of the printer;

a printhead assembly comprising a plurality of nozzle plates, each nozzle plate comprising a plurality of nozzles ejecting, disposed on the bottom of the ink cartridge, and arranged in a main scanning direction perpendicular to a paper feeding direction;

a platen disposed a predetermined distance below the printhead assembly, the platen to support a sheet of paper fed in the paper feeding direction, and having at least one slit formed entirely through a platen surface and formed in the main scanning direction to correspond to the nozzle plates; and a wiping apparatus to protrude through the at least one slit and to wipe the nozzle plates.

23. The inkjet printer of claim 22, wherein the ink storage unit includes an ink cartridge comprising an ink container.

24. The inkjet printer of claim 23, wherein the ink container stores a plurality of colors of ink.

25. The inkjet printer of claim 22, wherein the at least one slit comprises a plurality of slits.

26. The inkjet printer of claim 22, wherein the wiping apparatus is disposed under the platen.

27. An inkjet printer comprising:

an ink storage unit to store ink and fixed to a main body of the printer;

a printhead assembly comprising a plurality of nozzle plates, each nozzle plate comprising a plurality of nozzles to eject ink supplied from the ink container, disposed on the bottom of the ink cartridge, and arranged in a main scanning direction perpendicular to a paper feeding direction;

a supporting member disposed a predetermined distance below the printhead assembly, the supporting member to support a sheet of paper fed in the paper feeding direction and having at least one slit with an opening formed through a supporting member surface and formed in the main scanning direction to correspond to the nozzle plates; and a wiping apparatus that protrudes through the slit to wipe the nozzle plates.

28. The inkjet printer of claim 27, wherein the ink storage unit includes an ink cartridge comprising an ink container.

29. The inkjet printer of claim 28, wherein the ink container stores a plurality of colors of ink.

30. The inkjet printer of claim 27, wherein the at least one slit comprises a plurality of slits.

31. The inkjet printer of claim 27, wherein the wiping apparatus is disposed under the supporting member.

* * * * *